United States Patent [19]

Jury

[11] Patent Number: 4,514,998

[45] Date of Patent: May 7, 1985

[54] METAL FORMING MACHINE

[76] Inventor: Harold R. Jury, 22 Provident Ave., Glynde, Australia

[21] Appl. No.: 473,224

[22] Filed: Mar. 8, 1983

[30] Foreign Application Priority Data

Mar. 9, 1982 [AU] Australia ..... PF3019
Sep. 21, 1982 [AU] Australia ..... PF5977

[51] Int. Cl.[3] ..... B21D 22/10
[52] U.S. Cl. ..... 72/184; 72/207
[58] Field of Search ..... 72/184, 192, 207, 54, 72/57, 465

[56] References Cited

U.S. PATENT DOCUMENTS 1,547,250 7/1925 Wilson ..... 72/192
1,927,501 9/1933 Rafter ..... 72/181
2,319,785 5/1943 Abramsen ..... 72/99
3,521,472 7/1970 Bringewald ..... 72/184
3,785,191 1/1974 Dewey ..... 72/181
4,257,251 3/1981 Jury ..... 72/184

*Primary Examiner*—Lowell A. Larson
*Attorney, Agent, or Firm*—Henry Sternberg; Norbert P. Holler

[57] ABSTRACT

A machine for embossing comprises a pair of co-operating rollers parallel to but spaced from one another, and two pairs of pinch rollers also parallel to and spaced from one another, one pair of pinch rollers being effective to firmly grip a workpiece before it enters the embossing zone. One set of pinch rollers is located at each respective side of the embossing rollers, and a retractor coupling the upper roller of each said set to the machine frame, arranged in one mode to firmly grip the workpiece and in another mode to be clear of the workpiece. This arrangement enables the rolling machine to operate in two directions.

8 Claims, 4 Drawing Figures

METAL FORMING MACHINE

This invention relates to a machine which is useful for the embossing and shearing of sheet or thin plate metal.

BACKGROUND OF THE INVENTION

In U.S. Pat. No. 4,257,251 (Metal Forming Process), relating to an invention of which applicant herein was inventor, there was described and illustrated a machine which was useful for the embossing and shearing of sheet metal, the machine having three lower rollers and one upper roller, the lower rollers supporting a die plate and the upper roller being effective to compress an elastomer over a workpiece itself supported by a die plate. This process was very effective in both embossing and shearing of metal, and was particularly useful for relatively low production runs since it is merely necessary to change die plates and roller positions to change from one produce to another.

The main object of this invention is to provide certain improvements to the invention which was described in said Patent.

BRIEF SUMMARY OF THE INVENTION

One of the difficulties associated with embossing is the formation of puckers or wrinkles in the workpiece. This is particularly troublesome if the embossment is deep and requires considerable stretching of the metal of the workpiece.

In an embodiment of this invention a machine for embossing comprises a pair of co-operating rollers parallel to but spaced from one another, and two pairs of pinch rollers also parallel to and spaced from one another, one pair of pinch rollers being effective to firmly grip a workpiece before it enters the embossing zone. One set of pinch rollers is located each respective side of the embossing rollers, and retractor means couple the upper roller of each said set to the machine frame, arranged in one mode to firmly grip the workpiece and in another mode to be clear of the workpiece. This arrangement enables the rolling machine to operate in two directions.

More specifically, a metal forming machine according to this invention comprises a frame assembly, a pair of co-operating embossing rollers journalled for rotation in bearings carried by the frame assembly and positioned one above the other, drive means coupled to both said embossing rollers and arranged to drive the embossing rollers at similar peripheral speeds, two pairs of co-operating pinch rollers each of which is parallel to the embossing rollers, the pinch rollers of each pair also being journalled for rotation in bearings carried by the frame assembly and also being positioned one above the other, one of the pairs of pinch rollers being on one side of the embossing rollers and the other on the other side thereof.

Where a metal forming machine is to be used on short production runs there is a likelihood of the die thickness varying for different products, and consequently a need to vary the distance between the co-operating rollers. Thus in another embodiment of the invention, the machine comprises a fixed frame and an adjustable frame, guide means guiding the adjustable frame for vertical movement with respect to the fixed frame, and power operated screw and nut means between the fixed and adjustable frames for effecting said movement.

said bearings of the lower of said rollers being carried by the fixed frame and said bearings of the upper of said rollers being carried by the adjustable frame.

BRIEF DESCRIPTION OF THE DRAWINGS.

An embodiment of the invention is described hereunder in some detail with reference to and as illustrated in the accompanying drawings in which.

Figure 1:
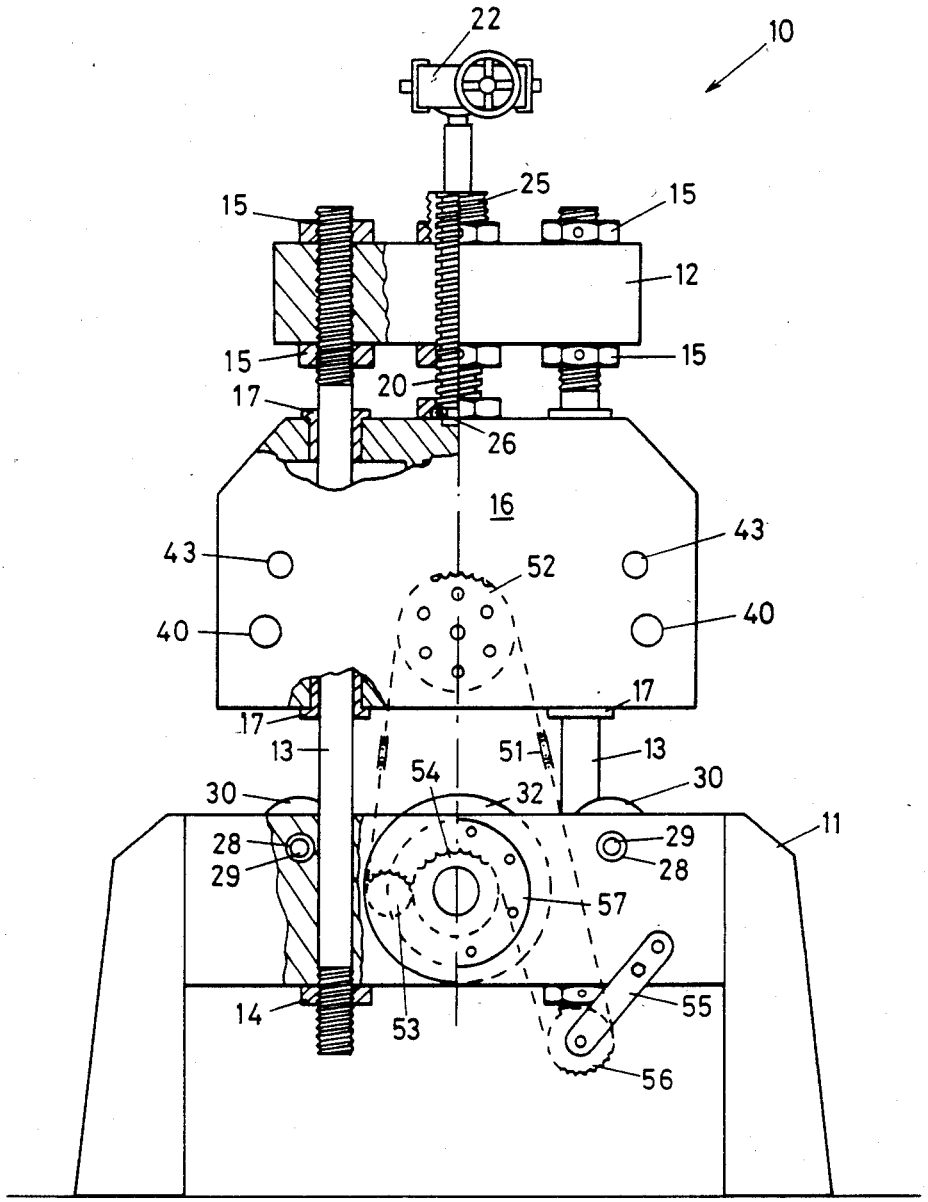
FIG. 1 is an end elevation of a metal forming machine.
Figure 2:
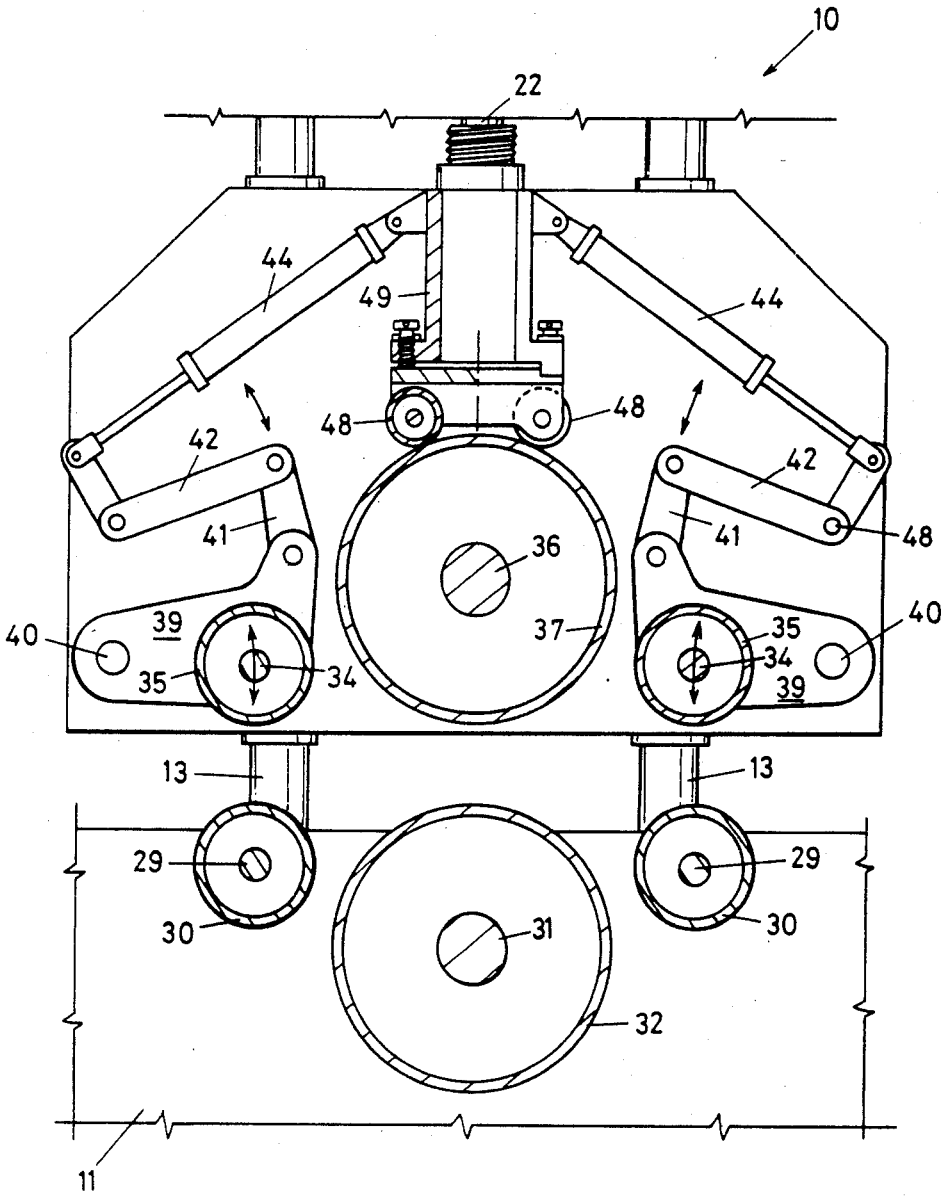
FIG. 2 is a general schematic section drawn to an enlarged scale, which illustrates the arrangement of the co-operating rollers.
Figure 3:
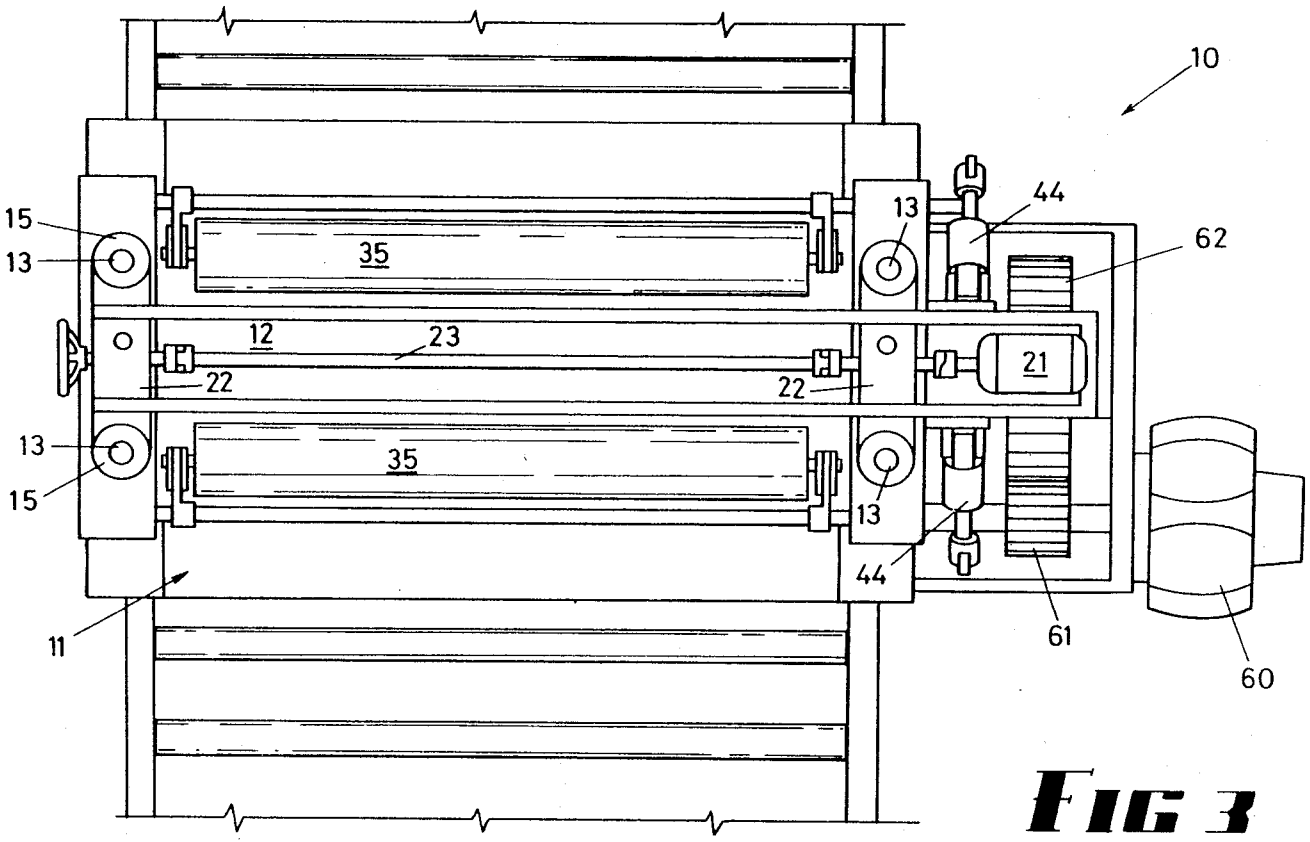
FIG. 3 is a plan view of FIG. 1, but drawn to a reduced scale.

Referring first to FIGS. 1, 2, and 3, a metal forming machine 10 comprises a frame assembly which includes a fixed frame having a frame base 11, a frame head 12, and four vertical guides 13 secured to the frame base by nuts 14 and to the frame head by nuts 15 and interconnecting the base 11 and head 12. An adjustable frame 16 is intermediate the base 11 and head 12 and has bushes 17 which guide it for movement over the vertical guides 13.

Adjustment of vertical movement is achieved by means of a pair of screws 20, one each end of the machine, and driven by an electric motor 21 through a pair of right angled gear boxes 22 and a transverse shaft 23 connecting the gearboxes. Each screw 20 engages a respective nut 25 at its respective end of the frame head 12, and is coupled by bearing 26 to the adjustable frame 16 such that the frame 16 is elevated or lowered at each end simultaneously.

There are three pairs of bearings in the frame base 11, the bearings 28 journalling for rotation shafts 29 of respective lower pinch rollers 30, and the central bearings (not shown) journalling the shaft 31 of the lower embossing roller 32.

Similarly, there are three pairs of bearings (not shown) in the adjustable frame 16 which respectively journal the shafts 34 of the upper pinch rollers 35, and the shaft 36 of the upper embossing rollers 37.

Figure 4:
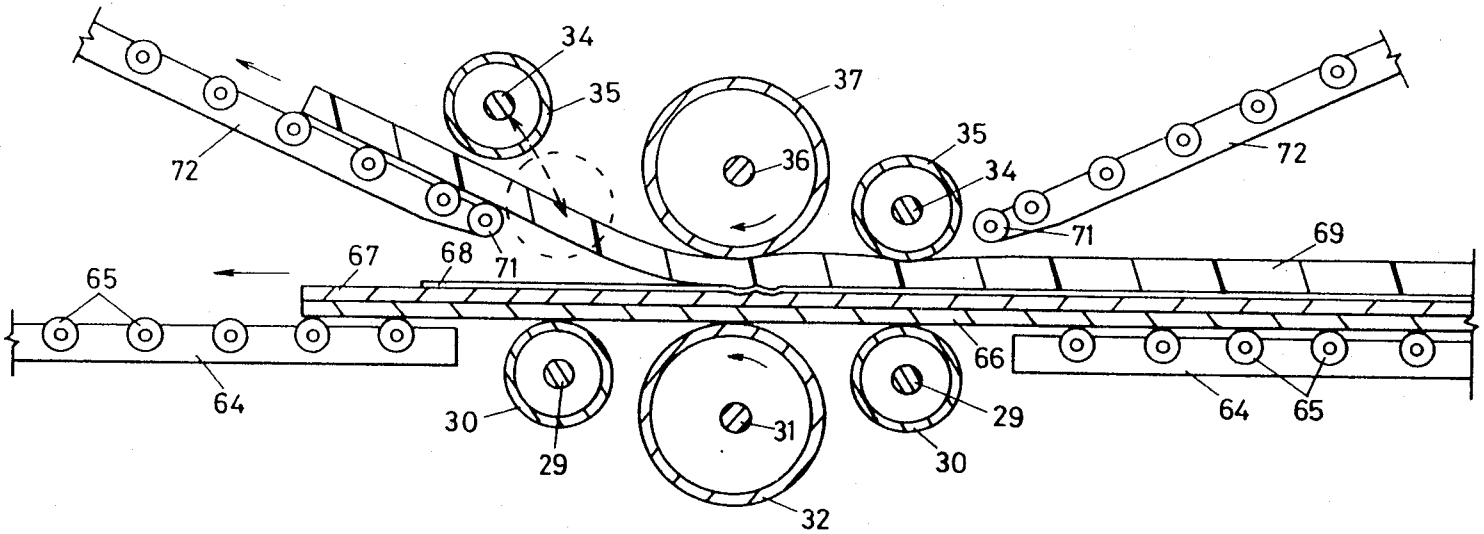
FIG. 4 is a schematic longitudinal section illustrating roller frames which extend upwardly and outwardly away from the upper pinch rollers.

In this embodiment the upper pinch rollers 35 are retractable as illustrated best in FIG. 4 and this is achieved by the bearings for the upper pinch rollers being in sub-frames each comprising bell crank shaped arms 39 themselves pivoted by pivot pins 40 to the end plates of the adjustable frame 16, the arms being coupled by short links 41 to control arms 42 on shafts 43, and controlled by piston/cylinder assemblies 44 at one end of the machine, which function to selectively retract the pinch rollers 35 as best shown in FIGS. 2 and 4.

The upper embossing roller 37 is itself stiffened by small support rollers 48 carried on an overhead frame 49 as shown best in FIG. 2 and this reduces the tendency for deflection to occur.

It is desirable that the peripheral speeds of the upper and lower embossing rollers 37 and 32 should at least be similar, preferably precisely identical. This is achieved by means of a roller chain 51 which extends over an upper sprocket 52 coupled to one end of the upper embossing roller 37, the chain passing over an idler sprocket 53 and a lower sprocket 54 which is coupled to the corresponding end of the lower embossing roller 32.

Since the space between the rollers will vary, use is made of an adjustable tensioning arm 55, itself having on one end an idler sprocket 56, and the location of this can be varied to apply the required degree of tension to roller chain 51, while at the same time the adjustable tension arm 55 can be slackened entirely if the space between the adjustable frame 16 and the frame base 11 is to be varied. Even if the rollers are arranged so that their peripheral speed is the same or almost the same, some slippage can take place during embossment and this is accommodated by means of a slipping clutch 57 which is operatively located between the lower sprocket 54 and its embossing roller 32 (although the slipping clutch can alternatively be located between upper sprocket 52 and its embossing roller 37). As shown in FIG. 3, drive for the embossing rollers is effected by a hydraulic motor 60 which drives a pinion 61 in mesh with a gear 62 on that end of the shaft 31 of lower roller 32 which is opposite the lower sprocket 54.

The machine is designed for use along with an elastomeric slab and a die plate. In many uses it is economic if the machine is operated firstly in a forward direction and secondly in a reverse direction, and the elastomeric slab can be of such dimension as to be difficult to handle. Furthermore, the die plate can sometimes be sufficiently flexible that the pressure imparted by the rollers 32 and 37 can cause bending.

FIG. 4 illustrates an arrangement which overcomes these problems. On each side of the lower pinch rollers 30 is located a conveyor frame 64 and each has a plurality of conveyor rollers 65 which support a base plate 66 on which is located a die plate 67, the upper surface of which is the embossing surface. The workpiece 68 is supported by the die plate 67 and this has on it an elastomeric slab 69 which is driven by the upper embossing roller 37 as the die plate and base plate are driven by the lower embossing roller 32. As shown in FIG. 4, the left hand upper pinch roller 35 is retracted, and upon passing beneath roller 37, the elastomeric slab 69 will normally tilt upwardly. In tilting upwardly, it engages the lowermost roller 71 on a roller frame 72 which slopes upwardly and outwardly away from the embossing roller 37. When the workpiece 68 has been embossed, the elastomeric slab 69 is then fully supported on the rollers of frame 72 on the left hand side of the machine, and the above described sequence of operations is then reversed whereupon the elastomeric slab 69 is transferred from the left hand roller frame 72 to the right hand roller frame 72. The roller frames define a shallow V-shape as shown in FIG. 4. The elastomeric slab 69 can be of material having characteristics and durometer hardness which can best be found empirically. One suitable material is elastomeric polyurethane.

I claim:

1. A metal forming machine having a frame assembly comprising a fixed frame, an adjustable frame carried by the fixed frame and adjustable with respect thereto, and a pair of sub-frames each movable with respect to the adjustable frame, a pair of co-operating embossing rollers located one above the other and respectively journalled for rotation in bearings carried by the adjustable frame and the fixed frame, drive means coupled to both said embossing rollers and arranged to drive the embossing rollers at similar peripheral speeds, two pairs of co-operating pinch rollers each of which is parallel to the embossing rollers, the pinch rollers of each pair also being positioned one above the other and respectively journalled for rotation in bearings carried by the sub-frame and the fixed frame, one of the pairs of pinch rollers being on one side of the embossing rollers and the other on the other side thereof, and respective piston/cylinder assemblies coupled between the sub-frames and one of the other said frames being operable to selectively retract the upper pinch rollers.

2. A metal forming machine according to claim 1 further comprising guide means guiding the adjustable frame for vertical movement with respect to the fixed frame, and power operated screw and nut means between the fixed and adjustable frames for effecting said movement.

3. A metal forming machine according to claim 2 wherein each said sub-frame comprises two pairs of pivoted arms, pivot means pivoting respective said arms to the adjustable frame for pivotal movement in vertical planes, the bearings of each upper of said pinch rollers being in respective arms of a respective said pair of pivoted arms, each of said piston/cylinder assemblies coupling said adjustable frame to a respective said pair of pivoted arms and being operable to retract said pivoted arms upwardly and thereby retract an upper said pinch roller from its co-operating lower pinch roller.

4. A metal forming machine having a frame assembly with a fixed frame, an adjustable frame and a pair of sub-frames, said fixed frame comprising a frame head, a frame base, and a plurality of vertical guides interconnecting the frame head and base, said adjustable frame being located between said fixed frame head and base, and having slide means engaging said guides thereby guiding the adjustable frame for vertical movement, a power driven screw and nut assembly operatively coupling the fixed frame head and the adjustable frame for effecting said vertical movement, three pairs of bearings in the frame base journalling a lower embossing roller and two lower pinch rollers for rotation about parallel axes, a further three pairs of bearings, one pair mounted in the adjustable frame and journalling an upper embossing roller and the other two pairs mounted in said sub-frames and journalling two upper pinch rollers for rotation about parallel axes, corresponding said upper and lower embossing and pinch rollers co-operating with one another, respective retraction means operable between the adjustable frame and said upper pinch rollers for selective retraction of said upper pinch rollers, and drive means coupled to both said embossing rollers arranged to drive said embossing rollers at similar peripheral speeds.

5. A metal forming machine according to claim 4 wherein said drive means comprises sprockets coupled to said embossing rollers, a chain tensioning arm pivoted to a said frame at its one end and having an idler sprocket journalled for rotation at its other end, and a chain extending around said sprockets.

6. A metal forming machine according to claim 5 further comprising a slipping clutch between a said embossing roller and its said sprocket.

7. A metal forming machine according to claim 4 or 5 further comprising a die support base plate carried by the lower of said rollers.

8. A metal forming machine according to claim 4 further comprising a pair of roller frames extending upwardly and outwardly away from the upper said pinch rollers so as to define a shallow 'V' and a plurality of free-running rollers carried by each said roller frame.

* * * * *